US011490215B2

(12) United States Patent
Hasani

(10) Patent No.: US 11,490,215 B2
(45) Date of Patent: Nov. 1, 2022

(54) HEARING AID

(71) Applicant: SIVANTOS PTE. LTD., Singapore (SG)

(72) Inventor: Hamed Hasani, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/169,749

(22) Filed: Feb. 8, 2021

(65) Prior Publication Data

US 2021/0250710 A1 Aug. 12, 2021

(30) Foreign Application Priority Data

Feb. 6, 2020 (DE) ..... 102020201479.5

(51) Int. Cl.
*H04R 25/00* (2006.01)
*H01Q 1/27* (2006.01)
*H04R 9/06* (2006.01)

(52) U.S. Cl.
CPC ..... *H04R 25/658* (2013.01); *H01Q 1/273* (2013.01); *H04R 9/06* (2013.01); *H04R 25/604* (2013.01); *H04R 2420/07* (2013.01)

(58) Field of Classification Search
CPC ... H04R 2225/51; H04R 25/65; H04R 25/554
See application file for complete search history.

(56) References Cited

U.S. PATENT DOCUMENTS 9,686,621 B2 * 6/2017 Akdeniz ..... H04R 25/554
9,888,327 B2 2/2018 Nikles et al.
9,980,062 B2 5/2018 Fischer et al.
2009/0231211 A1 * 9/2009 Zweers ..... H01Q 7/00 343/702
2010/0158295 A1 * 6/2010 Polinske ..... H01Q 1/243 343/866
2013/0002501 A1 1/2013 Li et al.
2013/0171951 A1 7/2013 Li et al.
2013/0343586 A1 * 12/2013 Kvist ..... H04R 25/554 381/315
2014/0010394 A1 * 1/2014 Kvist ..... H01Q 9/24 381/315
2015/0049891 A1 * 2/2015 Johnson ..... H04R 25/609 381/315

(Continued)

FOREIGN PATENT DOCUMENTS

CN 110177327 A 8/2019
DE 102014222451 A1 3/2016

(Continued)

*Primary Examiner* — Ryan Robinson
(74) *Attorney, Agent, or Firm* — Laurence A. Greenberg; Werner H. Stemer; Ralph E. Locher

(57) ABSTRACT

A hearing aid, in particular constructed as a classical hearing aid, includes a housing having a baseplate and a housing shell, a number of electrical and/or electronic units, and a transmitting and receiving unit for transmitting and receiving electromagnetic waves. The number of electrical and/or electronic units are fastened on the baseplate. The transmitting and receiving unit includes an electronic circuit for generating a transmission signal and an antenna unit coupled thereon. The antenna unit includes a free arm and the transmitting and receiving unit is configured to inductively feed the transmission signal of the electronic circuit into the antenna unit.

26 Claims, 8 Drawing Sheets

(56) References Cited

U.S. PATENT DOCUMENTS

| | | | | |
|---|---|---|---|---|
| 2016/0050501 | A1* | 2/2016 | Pinto | H04R 25/554 381/315 |
| 2017/0150278 | A1* | 5/2017 | Ruaro | H04R 25/60 |
| 2018/0124528 | A1* | 5/2018 | Polinske | H04R 25/602 |
| 2019/0069101 | A1* | 2/2019 | Kvist | H01Q 5/371 |
| 2019/0103661 | A1 | 4/2019 | Cousins et al. | |
| 2019/0261100 | A1* | 8/2019 | Troelsen | H01Q 1/273 |
| 2020/0107141 | A1* | 4/2020 | Kvist | H04R 25/604 |
| 2020/0136241 | A1* | 4/2020 | Shriner | H01Q 9/0421 |
| 2020/0203812 | A1* | 6/2020 | Murray | H01Q 9/285 |
| 2020/0251811 | A1* | 8/2020 | Elghannai | H04R 25/554 |
| 2020/0275218 | A1* | 8/2020 | Xue | H01Q 1/362 |
| 2020/0314567 | A1* | 10/2020 | Shriner | H01Q 1/273 |
| 2020/0404434 | A1* | 12/2020 | Shriner | H04R 25/65 |
| 2021/0266019 | A1* | 8/2021 | Perri | H04B 1/0343 |
| 2021/0306779 | A1* | 9/2021 | Knudsen | H04R 25/604 |
| 2021/0391644 | A1* | 12/2021 | Kawamura | H01Q 9/42 |

FOREIGN PATENT DOCUMENTS

| | | | | |
|---|---|---|---|---|
| EP | 1067565 | A2 | 1/2001 | |
| EP | 2285138 | A1 | 2/2011 | |
| EP | 2444982 | A1 | 4/2012 | |
| EP | 3720146 | A1 | 10/2020 | |
| WO | 2020001732 | A1 | 1/2020 | |
| WO | WO-2021097783 | A1 * | 5/2021 | H01Q 1/273 |

* cited by examiner

HEARING AID

CROSS-REFERENCE TO RELATED APPLICATION

This application claims the priority, under 35 U.S.C. § 119, of German Patent Application DE 10 2020 201 479.5, filed Feb. 6, 2020; the prior application is herewith incorporated by reference in its entirety.

BACKGROUND OF THE INVENTION

Field of the Invention

The invention relates to a hearing aid, which is constructed in particular as a classical hearing aid.

Classical hearing aids, which are used to care for the hard of hearing, are typically referred to as hearing aids. In the broader meaning, however, this term also refers to devices which are provided to assist people having normal hearing. Such hearing aids are also referred to as "Personal Sound Amplification Products" or "Personal Sound Amplification Devices" (abbreviated as: "PSAD"). They are not provided to compensate for hearing losses, but rather are intentionally used to assist and improve the normal human hearing ability in specific hearing situations, for example, to assist hunters when hunting or to assist animal observation, in order to be able to better perceive animal sounds and other noises produced by animals, for sports reporters, in order to enable improved speech and/or speech comprehension in complex background noise, for musicians, in order to reduce the strain on the sense of hearing, etc.

Independently of the provided intended use, hearing aids typically include an input transducer, a data and/or signal processing unit, which typically includes an amplifier, and an output transducer as important components. The input transducer is generally formed in this case by an acousto-electrical transducer, i.e., for example by a microphone, and/or by an electromagnetic receiver, for example an induction coil. An electro-acoustic transducer is usually used as an output transducer, for example a miniature loudspeaker (also referred to as an "earpiece"), or an electromechanical transducer, for example a bone vibrator, and the data and/or signal processing unit is generally implemented by an electronic circuit implemented on a printed circuit board.

Such hearing aids furthermore typically include an antenna unit or an antenna element as a so-called RF antenna, through the use of which the hearing aid can be coupled with respect to signaling, for example, to an operating element (remote control) and/or to a further hearing aid. In general, the same antenna unit or the same antenna element is used for transmitting and receiving data for reasons of space.

In a so-called binaural hearing device, two such hearing aids or hearing aid devices are worn by a user, wherein a wireless signal connection exists between the antenna units or antenna elements of the hearing aids in operation. In operation, wireless data, possibly also large quantities of data, are exchanged or transmitted in that case between the hearing aids on the right and left ear. The exchanged data and items of information enable particularly effective adaptation of the hearing aids to a respective acoustic situation. In particular, in that way a particularly authentic room sound is enabled for the user and also the speech comprehension is improved, even in loud environments.

Hearing aids are preferably embodied to be particularly space-saving and compact, so that they can be worn as visually inconspicuously as possible by a hearing aid user. Therefore, smaller and smaller hearing aids are being produced, which have an increasingly higher level of wearing comfort and are therefore hardly perceived by a user when worn on or in an ear. Due to the structural space thus reduced, however, it is increasingly more difficult to house and/or install conventional antenna units or antenna elements for wireless signal transmission in such hearing aids.

Those problems occur in particular in the case of in-the-ear hearing aids, which are generally mass-produced and are seated deep in an auditory channel or ear channel of the hearing aid user. Such hearing aids are preferably provided with compact structural space in such a way that they are disposed to be substantially visually invisible in the ear channel in the worn state.

BRIEF SUMMARY OF THE INVENTION

It is accordingly an object of the invention to provide a hearing aid, which overcomes the hereinafore-mentioned disadvantages of the heretofore-known hearing aids of this general type and which is advantageously constructed.

With the foregoing and other objects in view there is provided, in accordance with the invention, a hearing aid, in particular constructed as a classical hearing aid, including a housing having a baseplate and having a housing shell, a number of electrical and/or electronic units, and a transmitting and receiving unit for transmitting and receiving electromagnetic waves, wherein the number of electrical and/or electronic units are fastened on the baseplate, the transmitting and receiving unit includes an electronic circuit for generating a transmission signal and an antenna unit coupled thereon, the antenna unit includes a free arm, and the transmitting and receiving unit is configured to inductively feed the transmission signal of the electronic circuit into the antenna unit.

The hearing aid according to the invention is preferably constructed as a hearing aid of a type mentioned at the outset and is typically embodied as an in-the-ear hearing aid (ITE hearing aid), for example as a channel hearing aid (ITE: In-The-Ear, CIC: Completely-In-Channel, IIC: Invisible-In-The-Channel).

In this case, the hearing aid includes a housing having a baseplate, also called a faceplate, and having a housing shell. The housing is preferably formed in two parts herein and in this case the baseplate and the housing shell form the two parts.

Furthermore, the hearing aid includes a number of electrical and/or electronic units, i.e., one or more electrical and/or electronic units, also referred to as E-units in brief, wherein this number of electrical and/or electronic units are fastened on the baseplate. For example, an input transducer, i.e., for example, a microphone, forms one such E-unit. Alternatively or additionally, a battery or an accumulator forms one such E-unit and/or a data and/or signal processing unit mentioned at the outset, also referred to simply as a data processing unit hereinafter, forms a corresponding E-unit. A corresponding data processing unit typically includes an amplifier or provides an amplifier function in this case.

In addition, the hearing aid includes a transmitting and receiving unit for transmitting and receiving electromagnetic waves, wherein this includes an electronic circuit for generating a transmission signal and an antenna unit coupled thereto or an antenna element coupled thereto. This antenna unit typically includes an RF antenna of the type mentioned at the outset or forms such an antenna. Therefore, electromagnetic waves in the meaning of this application are to be understood in particular as radio signals, which are also referred to as RF signals.

The transmitting and/or receiving unit is functionally capable and configured to generate and/or evaluate RF signals transmittable or receivable by using the antenna unit. The transmission range is typically less than 18 m and is, for example, 10 m in this case. A range is to be understood in this case in particular as the signal range, i.e., a distance of the respective communication or signal connection which can exist at most between a transmitter and a receiver, so that a communication is still possible between them.

The antenna unit is furthermore preferably constructed as a radio frequency antenna (RF antenna) or as an RF resonator, for example for a 2.4 GHz Bluetooth transmission by using an ISM frequency band (ISM: Industrial, Scientific, and Medical). The antenna unit is therefore capable and configured to receive or absorb and to transmit or emit electromagnetic radio waves.

In the worn state, the hearing aid is preferably disposed substantially completely, but at least partially, in an ear channel or auditory channel of the user. The antenna element and/or the transmitting and/or receiving unit are preferably capable and configured in this case to correct attenuation and/or detuning of the RF signals due to the head of the user.

In the hearing aid according to the invention, the antenna unit includes a free arm and the transmitting and receiving unit is configured to inductively feed a transmission signal of the electronic circuit into the antenna unit. I.e., the antenna unit and the electronic circuit of the transmitting and receiving unit are galvanically separated from one another.

Inter alia, this has a positive effect on the efficiency of the antenna unit. Moreover, the transmitting and receiving unit is quasi shock resistant and or less susceptible to vibrations, since there is no electrically conductive mechanical connection, which could break, between the antenna unit and the electronic circuit of the transmitting and receiving unit.

In the meaning of this application, a free arm is to be understood in particular as an elongated conductor element or an elongated conductor track having at least one free end or free ends. Independently thereof, the antenna unit is only configured or formed for one resonance frequency, depending on the intended application. Moreover, the antenna unit only has the one free arm in some embodiment variants.

In order to enable a corresponding inductive feed or inductive coupling, the transmitting and receiving unit includes a coupling element, i.e., an inductive coupling element, which is galvanically connected to the electrical circuit and which includes a conductor loop or is formed by a conductor loop. The conductor loop or conductor hoop is formed in this case, depending on the structural variant, as a simple conductor loop or it forms one turn of a coil.

In addition, an embodiment is expedient in which the conductor loop includes an auxiliary component. The auxiliary component is in particular integrated into the conductor loop, so that the auxiliary component more or less forms a part or a segment of the conductor loop. The auxiliary component is typically an electrical component having an ohmic resistance, having a capacitance, and/or having an inductance, i.e., for example a capacitor, a coil, a resistor, or simply a conductor interruption, i.e., a quasi-gap.

In one advantageous refinement, the coupling element includes two conductor loops disposed adjacent to one another. The two conductor loops are preferably not disposed coaxially and in particular enclose two surfaces spatially separated from one another. It is expedient in this case if the transmitting and receiving unit is configured in such a way that opposing rotational directions for the courses or paths of the current of a transmission signal through the two conductor loops are predetermined for the two conductor loops. In this way, magnetic fields having opposing magnetic field directions are then generated using the two conductor loops.

Depending on the embodiment variant, the two conductor loops are furthermore formed as simple conductor loops or each of the two conductor loops forms one turn of a coil, so that in this case two coils are disposed adjacent to one another.

In addition, an embodiment is expedient in which each of the two conductor loops includes an auxiliary component of the above-mentioned type. The two conductor loops preferably have identical auxiliary components to implement a symmetrical structure.

Furthermore, an embodiment variant is preferred in which the coupling element includes a shared supply line, in particular an elongated supply line, for the two conductor loops, which the two conductor loops adjoin. In addition, the two conductor loops are preferably symmetrically formed and the shared supply line is preferably in the plane of symmetry. According to one embodiment variant, the supply line has an auxiliary component of the above-described type in this case.

Depending on the intended application, the two conductor loops are moreover connected through a connecting element to the electronic circuit of the transmitting and receiving unit, wherein the connecting element is preferably constructed as a waveguide or as a coaxial cable. If the connecting element is constructed as a waveguide, the waveguide is thus typically constructed as a coplanar waveguide and in particular includes three conductor strips. These are expediently disposed in parallel to one another, wherein the middle conductor strip is then typically connected to the shared supply line and the outer conductor strips are each connected to one of the two conductor loops. With such an embodiment, in operation of the transmitting and receiving unit, the feed or readout of a signal typically takes place through the middle conductor strip and a ground potential or reference potential is predetermined for the outer conductor strips.

Furthermore, the antenna unit typically includes a feed arm and the above-mentioned two conductor loops are preferably disposed symmetrically in relation to the feed arm. In particular, an embodiment is favorable in this case in which the above-mentioned shared supply line is aligned and positioned in parallel to the feed arm. Depending on the application, the feed arm, either alone or together with a conductor structure adjoining thereon, additionally forms an S-shaped or Z-shaped conductor structure. Independently thereof, the supply line includes an auxiliary component of the above-described type in some cases.

According to a further embodiment variant, the antenna unit includes an electrically conductive auxiliary element, which is constructed in particular for shielding the free arm against the number of electrical and/or electronic units. A ground potential or reference potential is preferably predetermined for the auxiliary element in operation of the hearing aid, wherein the electrically conductive auxiliary element is electrically conductively connected, for example, to a battery of the hearing aid for this purpose.

In particular due to the shielding effect of the auxiliary element, freedoms advantageously result in the configuration of the hearing aid and in particular in the configuration of the antenna unit in such a way that possible interference frequencies from the E-units do not have to be taken into consideration in the selection of the resonance frequencies or the resonance frequency for the antenna unit, so that the antenna unit and E-units can be optimized quasi-independently of one another.

The possibility is thus provided, for example, of using a simpler amplifier or a simpler amplifier function and thus a simpler data processing unit for the amplification of transmission signals and/or reception signals. In at least one application, the hearing aid then also includes such a simpler amplifier or a simpler data processing unit. Moreover, a corresponding amplifier may be positioned more freely, i.e., the selection of a suitable position for the amplifier is to be taken into consideration less. Reference is typically made in such cases to a "floating amplifier."

Due to the additional freedoms in the specification of the resonance frequency or the resonance frequencies, it is moreover possible in some cases to dispense with adaptation elements, for example an ohmic resistor, a coil, a capacitor, and/or a balun, and in the case of at least one embodiment, the antenna unit also does not have such an adaptation element. I.e., in at least one application an adaptation element of the above-mentioned type is omitted in the hearing aid according to the invention.

Notwithstanding this, the auxiliary element is expediently positioned between the free arm and the number of E-units. Moreover, the auxiliary element is preferably positioned between the free arm and the electronic circuit of the transmitting and receiving unit.

Furthermore, an embodiment is advantageous in which the auxiliary element includes or forms a curved conductor, a conductor loop, or a conductor hoop. If the shielding element includes a conductor loop or conductor hoop, the number of E-units is thus expediently positioned within the conductor loop or the conductor hoop and/or the electronic circuit of the transmitting and receiving unit is positioned within the conductor loop or the conductor hoop. If the shielding element includes a curved conductor, this typically thus at least partially encloses the number of E-units and/or the electronic circuit of the transmitting and receiving unit. Moreover, a geometry of the auxiliary element is advantageous in which the auxiliary element is formed at least approximately annularly, i.e., has a ring shape. However, in this case the geometry does not necessarily correspond to a geometrical circle. Moreover, the ring shape is also not necessarily closed. However, the curved conductor, the conductor loop, or the conductor hoop preferably spans at least an arc range or angle range of at least 120°, more preferably of at least 180°, and in particular of at least 250° or of at least 300°.

In particular if the auxiliary element includes a type of conductor loop, it is moreover advantageous if the free arm at least partially encloses the auxiliary element and at the same time, for example, spans or covers an arc range or angle range of at least 90°. The course of the free arm in at least one section then furthermore preferably follows the course of the auxiliary element in a good approximation, wherein the free arm moreover preferably extends at approximately equal distance from the auxiliary element in this region.

Furthermore, an embodiment variant is preferred in which the free arm is connected through a short-circuit arm to the auxiliary element. The short-circuit arm is typically connected at a first end of the free arm to the free arm in this case. According to one embodiment variant, the short-circuit arm furthermore includes an auxiliary component of the above-described type.

In addition, the free arm is preferably connected through the above-mentioned feed arm to the auxiliary element and/or through an auxiliary component of the above-described type.

Furthermore, an embodiment variant is expedient in which the auxiliary element and/or the free arm has a widened free end. Widened is to be understood in particular to mean that the corresponding free end or the corresponding exposed end has a transverse extension which corresponds to at least 1.2 times, preferably at least 1.5 times, and more preferably at least 2 times the transverse extension away from the free end.

Notwithstanding this, it is expedient if the auxiliary element and/or the free arm includes an auxiliary component of the above-described type.

Furthermore, embodiment variants are favorable in which an additional arm branches off from the free arm and in particular does so spaced apart from the ends of the free arm. The additional arm is constructed herein in the case of some embodiments as a further free arm, i.e., as an elongated conductor having a free end, and includes, for example, a widened end of the above-mentioned type and/or an auxiliary component of the above-mentioned type.

In one advantageous refinement, the antenna unit is constructed like a so-called PIF antenna (Planar Inverted F-shaped antenna). In this case, a ground potential or reference potential is then typically predetermined for the auxiliary element in operation of the hearing aid. An above-mentioned short-circuit arm, an above-mentioned feed arm, and the free arm then typically form an F-shaped main pattern made of a conductive material, for example copper.

Furthermore, an embodiment is preferred in which at least a part of the antenna unit, in particular the complete antenna unit, and/or at least a part of the coupling element, in particular the complete coupling element, only has a very small extension in one spatial direction, typically less than or equal to 1 mm. Furthermore, the at least one part of the antenna unit, in particular the complete antenna unit, and/or the at least one part of the coupling element, in particular the complete coupling element, is preferably substantially in a plane, the normal of which is aligned in parallel to this spatial direction. Then, for example, at least a part of the free arm and/or at least the free arm and/or at least the above-mentioned auxiliary element is thus substantially in one plane. Alternatively or additionally, for example, the above-mentioned conductor loop of the coupling element or the above-mentioned two conductor loops are substantially in one plane.

In addition, an embodiment is advantageous in which the antenna unit is formed by conductor tracks or includes at least a number of conductor tracks, which are applied to a substrate or to the baseplate, for example, and which form, for example, at least a part of the free arm and/or at least the free arm and/or at least the above-mentioned auxiliary element.

Furthermore, it is advantageous if the coupling element is formed by a number of conductor tracks or includes at least a number of conductor tracks which are applied, for example, to a substrate or to the baseplate, and which form, for example, at least the above-mentioned conductor loop or the above-mentioned two conductor loops.

In one advantageous refinement, the transmitting and receiving unit includes a number of conductor tracks which are applied to a shared substrate, wherein a first portion of these conductor tracks forms at least a part of the antenna unit, a second portion of these conductor tracks forms at least a part of the coupling element, the first portion is applied to a first side of the substrate and the second portion is applied to an opposite second side of the substrate.

Independently thereof, corresponding conductor tracks are, for example, printed on or applied with the aid of a coating method. In this case, for example, a film or a flexible printed circuit board (flexible PCB) is used as the substrate, if used.

Furthermore, a modification or refinement of the antenna unit is expedient in which the free arm is formed as an expanded free arm and in this case includes a conductor expansion made of an electrically conductive material, by which, for example, a branch or fork is formed. Through the use of the conductor expansion, the free arm is preferably capacitively charged starting from an embodiment of the free arm without conductor expansion and in this way a resonance condition for the antenna unit is typically predetermined.

A corresponding conductor expansion is preferably, but not necessarily, not formed by conductor tracks and is also not in the above-mentioned plane, which is predetermined in particular by a surface of the above-mentioned substrate. Instead, the conductor expansion is preferably more or less guided or tilted out of this plane.

The conductor expansion is typically formed, inter alia, by a connecting arm, which protrudes from the substrate and is connected to a conductor track end or a widened conductor track end of a conductor track on the substrate. The corresponding conductor track then forms the free arm together with the conductor expansion. A cross conductor, for example, which then forms a T shape together with the connecting arm, adjoins the connecting arm. Depending on the application, a U-shaped conductor element in turn adjoins the cross conductor at each of the two ends, wherein the opening of the U shape preferably faces toward the substrate.

According to a further embodiment variant, an above-described conductor expansion is not part of the free arm but part of the above-described additional arm or adjoins the above-described additional arm.

It is additionally expedient if a ground potential or reference potential for the above-mentioned auxiliary element is predetermined in operation of the hearing aid, for example by a battery or an accumulator, and if the auxiliary element quasi-relays this potential to at least one of the above-mentioned E-units, for example the data processing unit of the hearing aid.

Other features which are considered as characteristic for the invention are set forth in the appended claims.

Although the invention is illustrated and described herein as embodied in a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
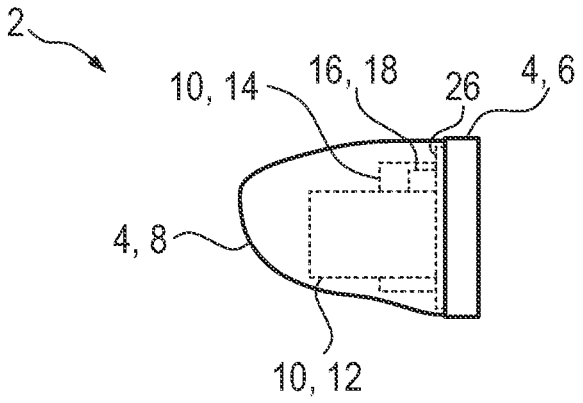
FIG. 1 is a simplified, diagrammatic and partially transparent plan view of a hearing aid having an antenna unit and having a coupling element on a shared substrate.

Referring now in detail to the figures of the drawings, in which parts corresponding to one another are each provided with the same reference signs, and first, particularly, to FIG. 1 thereof, there is seen a simplified and partially transparent illustration of a hearing aid 2 which is described below as an example and includes a housing 4 having a baseplate 6 and a housing shell 8. In this case, the housing 4 is constructed in such a way that the baseplate 6 is reversibly detachably connected to the housing shell 8 when the housing 4 is formed and the baseplate 6 may be detached from the housing shell 8 by actuating a pushbutton (not shown) on the baseplate 6.

Furthermore, in the exemplary embodiment, a number of electrical and/or electronic units, referred to below as E-units 10 for short, are fastened on the baseplate 6. In the exemplary embodiment, a battery 12 and a data processing unit 14 each form one of these E-units 10. A further E-unit 10, i.e., a further additional one of the number of E-units 10, is formed by an electronic circuit 16 of a transmitting and receiving unit 18.

In this case, the transmitting and receiving unit 18 is configured to transmit and receive electromagnetic waves in operation of the hearing aid 2, in particular for communication with a second hearing aid (not shown). The electronic circuit 16 and an antenna unit 20, which is shown in a first embodiment in FIG. 2, are part of the transmitting and receiving unit 18 in this case.

This antenna unit 20 is preferably configured like a so-called PIF antenna and typically includes an electrically conductive auxiliary element 22, for which a ground potential or reference potential is preferably predetermined in operation of the hearing aid 2. In the exemplary embodiment according to FIG. 2, the auxiliary element 22 is formed by a conductor loop, which has a ring shape in rough approximation. In this case, the auxiliary element 22 encloses or surrounds the above-mentioned E-units 10 and in this way shields a free arm 24 of the antenna unit 20 from these E-units 10.

Figure 5:
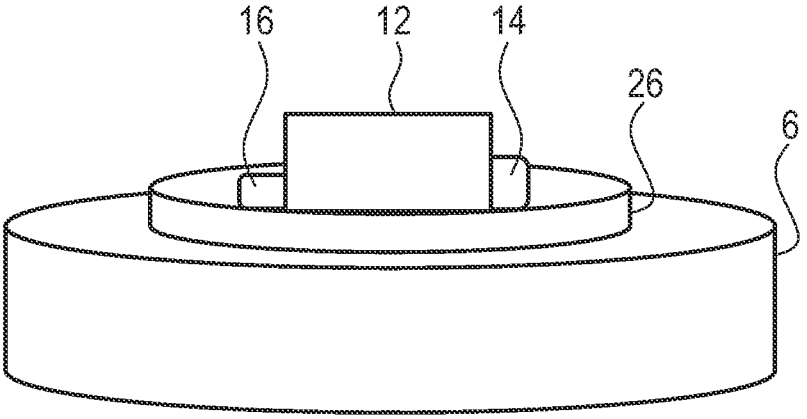
FIG. 5 is a simplified perspective view of a part of the hearing aid having a baseplate, one electrical and two electronic units, and the substrate.

The auxiliary element 22 and the free arm 24 are in one plane in this case and are each formed as conductor tracks, for example made of copper. Furthermore, these conductor tracks are applied, for example printed, on a first side of a substrate 26. This first side is shown in FIG. 2. In the exemplary embodiment, a film forms the substrate 26 and, to form the hearing aid 2, this film, together with the already applied conductor tracks, is preferably quasi-pulled over the E-units 10, applied to the baseplate 6 of the housing 4, and adhesively bonded to the baseplate 6. This configuration is indicated diagrammatically in FIG. 5. The E-units 10 penetrate a central passage in the substrate 26 in this case.

Figure 2:
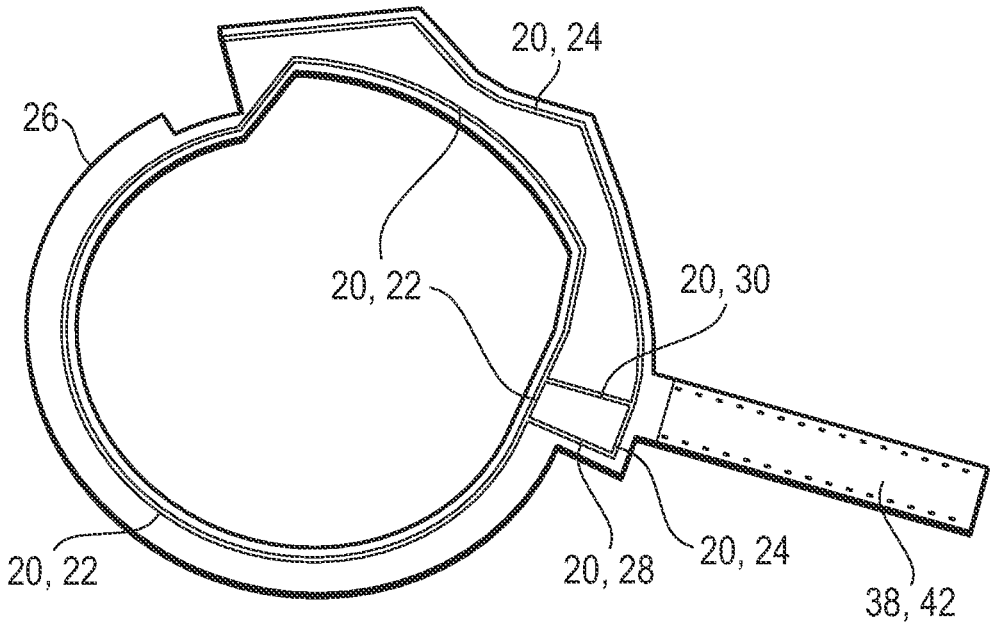
FIG. 2 is a perspective view in a first embodiment of a first side of the substrate having the antenna unit applied thereon.

In the exemplary embodiment according to FIG. 2, the above-mentioned free arm 24 at least partially encloses the auxiliary element 22 and is connected at one end through a short-circuit arm 28 to the auxiliary element 22. Moreover, in the exemplary embodiment according to FIG. 2, a feed arm 30, through which the antenna unit 20 is also connected to the auxiliary element 22, branches off from the free arm 24 spaced apart from the short-circuit arm 28.

In order to feed a signal to be transmitted into the antenna unit 20 or to read out a received signal, the transmitting and receiving unit 18 furthermore includes a coupling element 32. The coupling element 32 is also formed by conductor tracks in the exemplary embodiment and these conductor tracks are applied in this embodiment variant on the same substrate 26 as the antenna unit 20, but on the second side of the substrate 26 opposite to the first side. This second side is shown in a first embodiment in FIG. 3.

Figure 3:
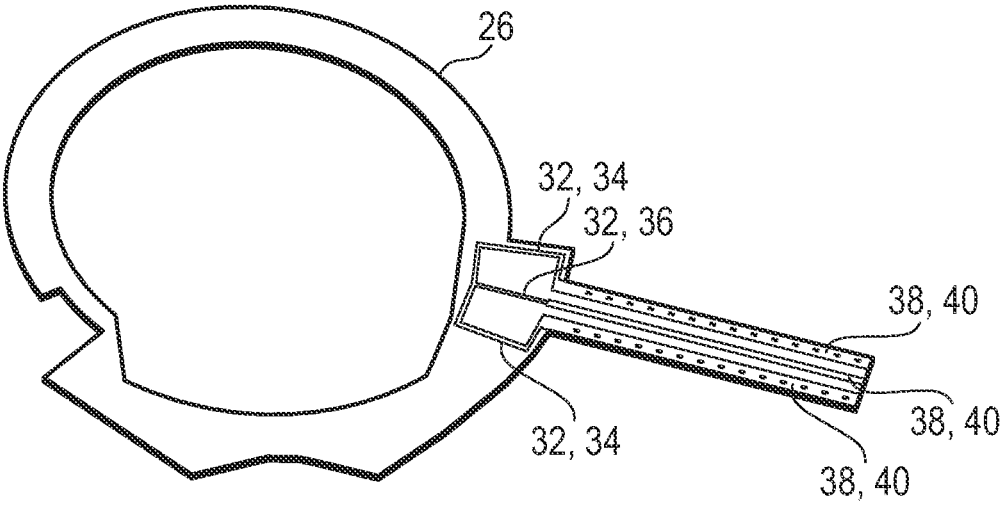
FIG. 3 is a perspective view in a first embodiment of a second side of the substrate having the coupling element applied thereon.
Figure 4:
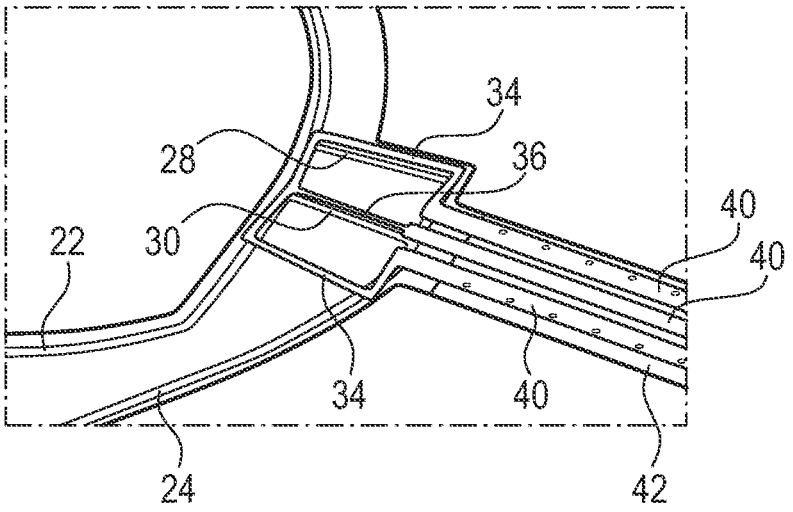
FIG. 4 is a fragmentary, perspective view of the antenna unit in the first embodiment and the coupling element in the first embodiment in their relative configuration to one another.

In the exemplary embodiment according to FIG. 3, the coupling element 32 now forms two conductor loops 34 disposed adjacent to one another. The two conductor loops 34, as can be seen from FIG. 3, are connected to one another in this case through a shared supply line 36, to which the two conductor loops 34 are attached. The coupling element 32 is furthermore disposed in the exemplary embodiment in relation to the antenna unit 20 in such a way that the supply line 36 is disposed in good approximation in parallel to the feed arm 30 and the conductor loops 34 are symmetrical to the feed arm 30. This relative configuration is shown in FIG. 4, wherein in this configuration only the conductor tracks are shown and the substrate 26 is hidden.

The coupling element 32 is connected to the electronic circuit 16 of the transmitting and receiving unit 18 through a connecting element 38. This connecting element 38 is constructed in the exemplary embodiment as a coplanar waveguide, which includes three conductor strips 40. The three conductor strips 40 are disposed in parallel to one another and coplanar in this case and the outer two outer conductor strips 40 are each connected to one of the conductor loops 34. The middle conductor strip 40 is additionally connected to the supply line 36 and a signal is fed in or read out therethrough in operation of the transmitting and receiving unit 18 as needed.

The conductor strips 40 are preferably supplemented by a conductor surface 42, which is applied in particular to the first side of the substrate 30 and which is subjected in operation of the transmitting and receiving unit 18, like the two outer conductor strips 40, to a ground potential or reference potential. This ground potential or reference potential is provided in this case by the electronic circuit 16 of the transmitting and receiving unit 18 and is supplied through a galvanic connection.

As already mentioned above, the auxiliary element 22 is preferably also subjected to a ground potential or reference potential, but in the exemplary embodiment this is provided through a galvanic connection to the battery 12. The auxiliary element 22 and the coupling element 32 are galvanically separated from one another.

Figure 6:
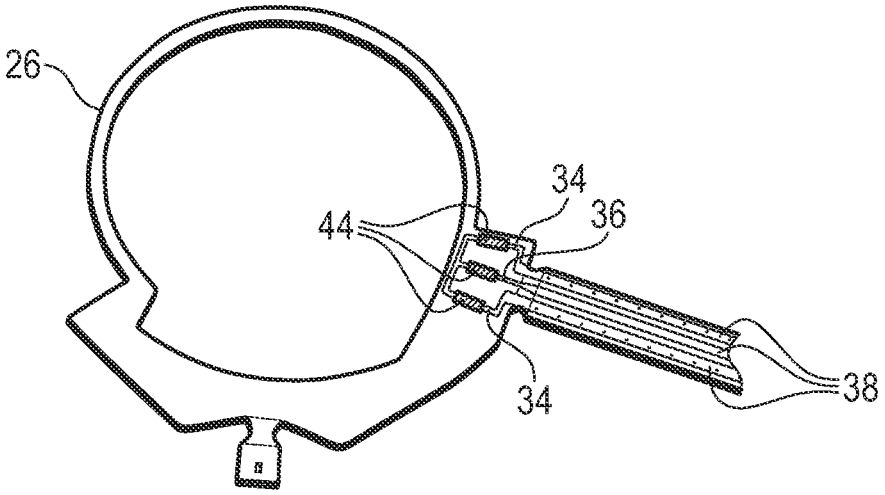
FIG. 6 is a perspective view in a second embodiment of the second side of the substrate having the coupling element applied thereon.

A second embodiment of the coupling element 32 is shown in FIG. 6. This embodiment differs from the embodiment according to FIG. 3 above all in that an auxiliary component 44 is integrated in the shared supply line 36 and also in each of the two conductor loops 34. The structure is preferably made symmetrical and the three auxiliary components 44 are in particular similar auxiliary components 44.

Independently thereof, an auxiliary component 44 in the meaning of this application is typically an electrical component having an ohmic resistance, having a capacitance, and/or having an inductance, i.e., for example a capacitor, a coil, a resistor, or simply a conductor interruption, i.e., a quasi-gap.

Figure 7:
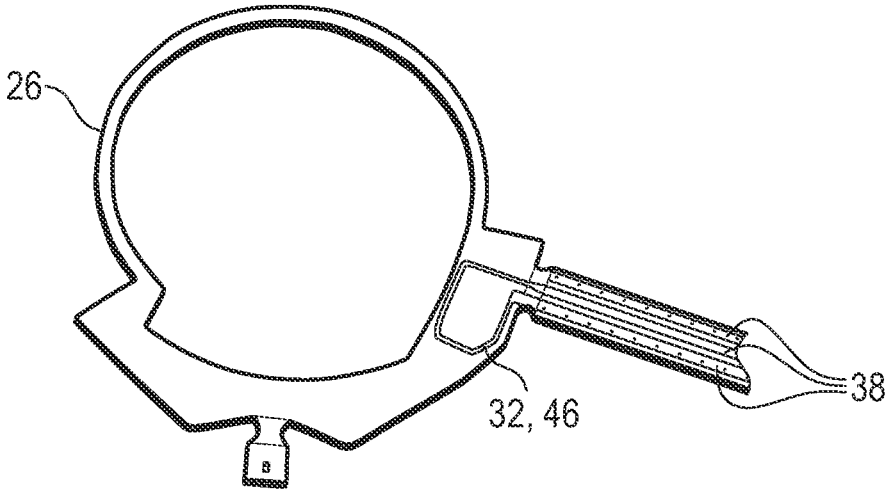
FIG. 7 is a perspective view in a third embodiment of the second side of the substrate having the coupling element applied thereon.

A third embodiment of the coupling element 32 is shown in FIG. 7. The coupling element 32 only includes one conductor loop 46 in this case instead of the above-described two conductor loops 34.

Further embodiment variants of the antenna unit 20 are shown in FIG. 8 to FIG. 15. A second embodiment variant according to FIG. 8 differs in this case from the embodiment according to FIG. 2 due to the configuration of the free arm 24, on one hand, and the configuration of the auxiliary element 22, on the other hand. The auxiliary element 22 according to FIG. 8 thus does not have a ring shape or at least not a closed ring shape, rather the auxiliary element 22 is formed by a curved conductor having a free end. The curved conductor spans an arc range or angle range of greater than 180° and therefore in turn forms a conductor loop or conductor hoop. The free end of the auxiliary element 22 and the free end of the free arm 24 are moreover embodied as widened ends or widened free ends, the corresponding free ends thus each have a widening 48.

The term "widened" is to be understood in particular to mean that the corresponding free end has a transverse extension which corresponds to at least 1.2 times, preferably at least 1.5 times, and more preferably at least 2 times the transverse extension of the corresponding conductor element away from the free end.

Figure 8:
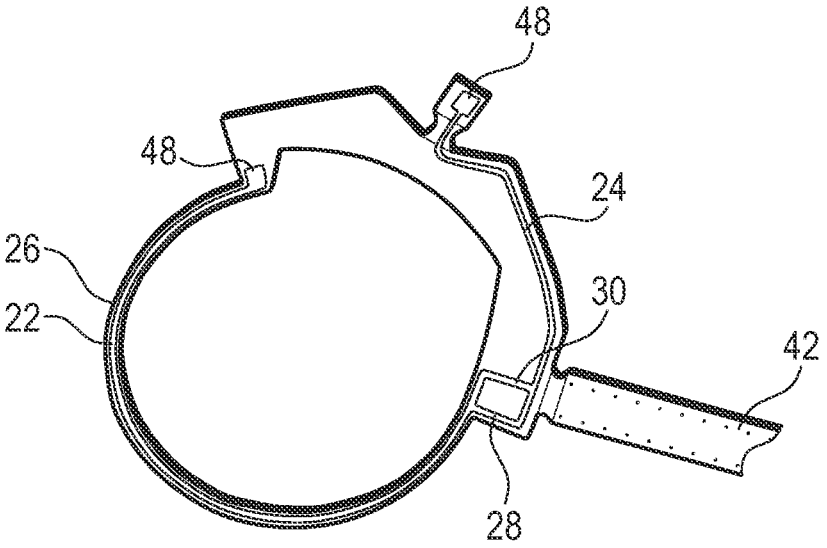
FIG. 8 is a perspective view in a second embodiment of the first side of the substrate having the antenna unit applied thereon.
Figure 9:
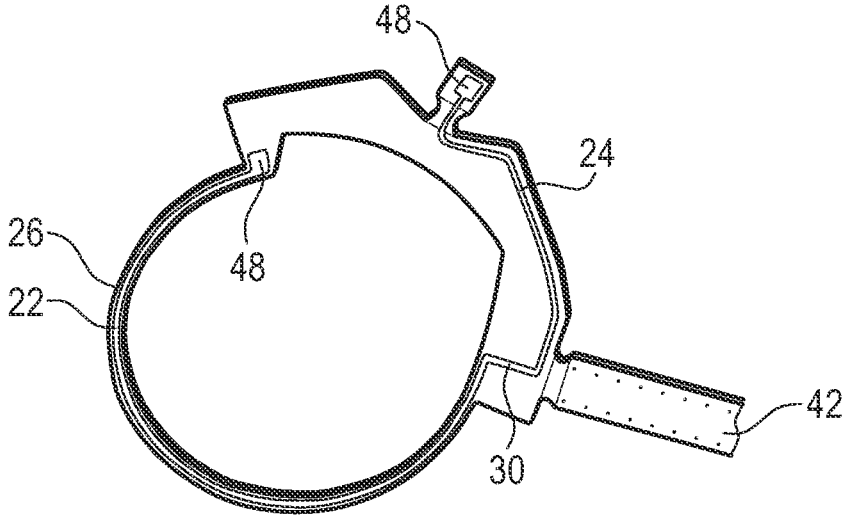
FIG. 9 is a perspective view in a third embodiment of the first side of the substrate having the antenna unit applied thereon.

A third embodiment variant according to FIG. 9 differs from the embodiment according to FIG. 8 in that the short-circuit arm 28 is not provided. The free arm 24 and the auxiliary element 22 are as a result connected to one another solely through the feed arm 30. In this case, the feed arm 30, together with the conductor structure of free arm 24 and auxiliary element 22 adjoining thereon, forms a Z-shaped conductor structure or a Z-shaped course of the conductor tracks forming the antenna unit 20.

Figure 10:
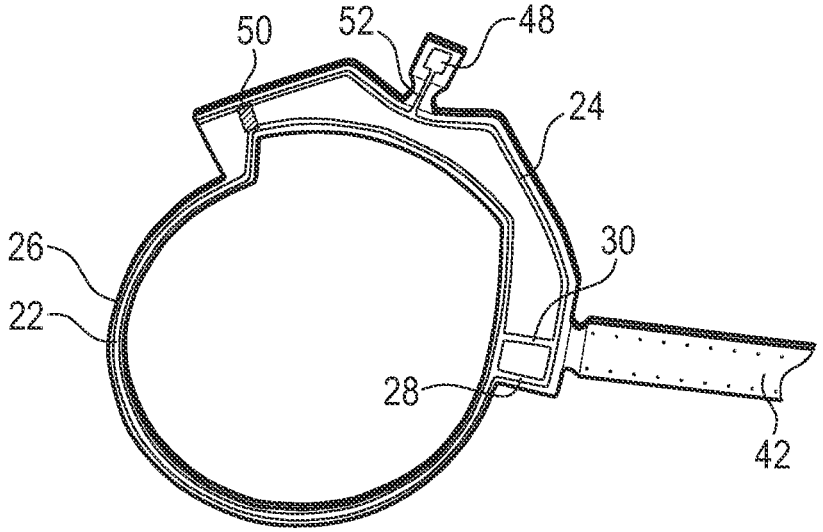
FIG. 10 is a perspective view in a fourth embodiment of the first side of the substrate having the antenna unit applied thereon.
Figure 11:
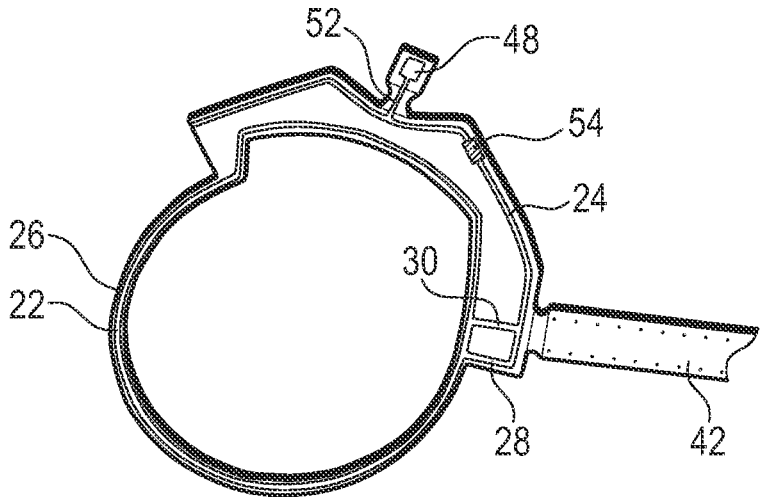
FIG. 11 is a perspective view in a fifth embodiment of the first side of the substrate having the antenna unit applied thereon.
Figure 12:
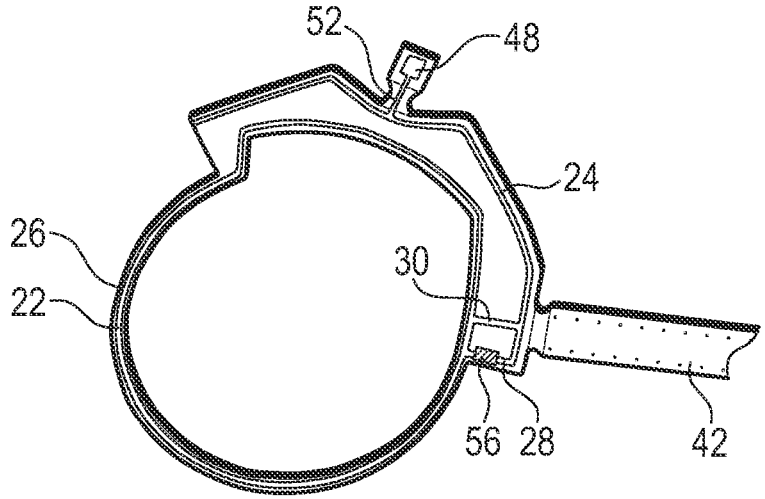
FIG. 12 is a perspective view in a sixth embodiment of the first side of the substrate having the antenna unit applied thereon.
Figure 13:
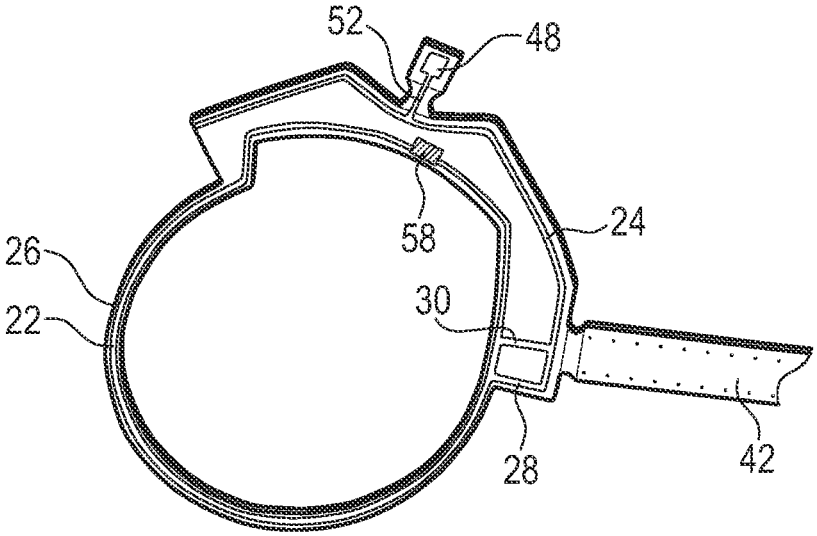
FIG. 13 is a perspective view in a seventh embodiment of the first side of the substrate having the antenna unit applied thereon.
Figure 14:
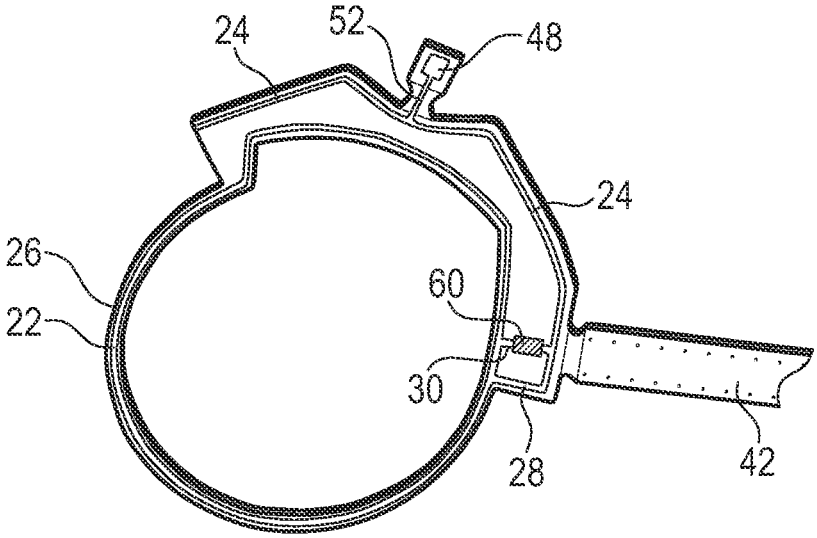
FIG. 14 is a perspective view in an eighth embodiment of the first side of the substrate having the antenna unit applied thereon.

A fourth variant is illustrated in FIG. 10. This variant differs from the embodiment according to FIG. 2 by way of an auxiliary component 50 of the above-mentioned type, which connects the free arm 24 to the auxiliary element 22. Moreover, in the antenna unit 20 according to FIG. 10, an additional arm 52 branches off from the free arm 24, and does so spaced apart from the two ends of the free arm 24. This additional arm 52 preferably points away from the auxiliary element 22 and moreover preferably has a terminal widening 48 of the abovementioned type.

The further embodiment variants of the antenna unit 20 according to FIG. 11 to FIG. 14 differ from the embodiment according to FIG. 10 by way of the position and possibly the embodiment of the auxiliary components 54 to 60, wherein each auxiliary component 54 to 60 is embodied as an auxiliary component of the abovementioned type. The auxiliary components 54 to 60 are thus embodied in particular as electrical components of the above-mentioned type, but depending on the application possibly as different electrical components.

Figure 15:
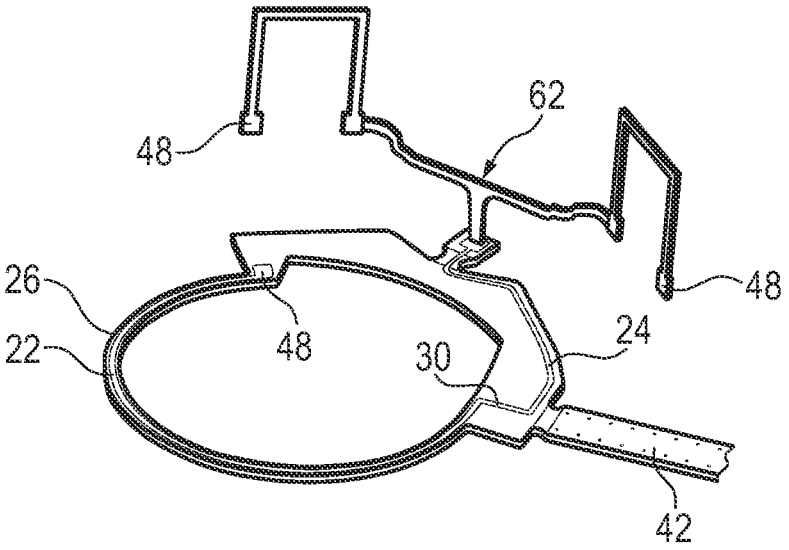
FIG. 15 is a perspective view in a ninth embodiment of the first side of the substrate having the antenna unit applied thereon.

The embodiment variant of the antenna unit 20 according to FIG. 15 represents a modification or refinement of the antenna unit 20 according to FIG. 9. In the embodiment according to FIG. 15, the free arm 24 is formed as an expanded free arm 24 and includes a conductor expansion 62 made of an electrically conductive material, by which, for example, a branch or fork is formed. Through the use of the conductor expansion 62, the free arm 24 is preferably capacitively charged proceeding from the configuration of the free arm 24 according to FIG. 9 and in this way a resonance condition for the antenna unit 20 is typically predetermined.

In this exemplary embodiment, in contrast to the auxiliary element 22, the feed arm 30, and the remainder of the free arm 24, the conductor expansion 62 is not formed by conductor tracks and is also not in the above-mentioned plane, which is predetermined by a surface of the substrate 26. Instead, the conductor expansion 62 is more or less guided or tilted out of this plane. The conductor expansion 62 is formed in the exemplary embodiment, inter alia, by a connecting arm, which protrudes from the substrate 26 and is connected to a conductor track end or a widened conductor track end of a conductor track on the substrate. The corresponding conductor track also forms the free arm 24 in the embodiment of the antenna unit 20 according to FIG. 15. It corresponds with respect to the configuration to the conductor track which forms the free arm 24 alone in the embodiment of the antenna unit 20 according to FIG. 9.

A cross conductor, which forms a T-shape together with the connecting arm, adjoins the connecting arm in the exemplary embodiment according to FIG. 15. A U-shaped conductor element in turn adjoins each of the two ends of the cross conductor in the exemplary embodiment, wherein the opening of the U shape preferably faces toward the substrate 26.

According to a further embodiment variant (not shown), an above-described conductor expansion 62 is not part of the free arm 24 but part of the above-described additional arm 52 or adjoins the above-described additional arm 52.

LIST OF REFERENCE NUMERALS

2 hearing aid
4 housing
6 baseplate (faceplate)
8 housing shell
10 E-unit
12 battery
14 data processing unit
16 electronic circuit
18 transmitting and receiving unit
20 antenna unit
22 auxiliary element
24 free arm
26 substrate
28 short-circuit arm
30 feed arm
32 coupling element
34 conductor loop
36 supply line
38 connecting element
40 conductor strip
42 conductor surface
44 auxiliary component
46 conductor loop
48 widening
50 auxiliary component
52 additional arm
54 auxiliary component
56 auxiliary component
58 auxiliary component
60 auxiliary component
62 conductor expansion

The invention claimed is:

1. A hearing aid or classical hearing aid, comprising:
a housing having a baseplate and a housing shell;
a plurality of at least one of electrical or electronic units fastened on said baseplate;
a transmitting and receiving unit for transmitting and receiving electromagnetic waves, said transmitting and receiving unit including an electronic circuit for generating a transmission signal and an antenna unit coupled on said electronic circuit;
said transmitting and receiving unit including a coupling element connected to said electronic circuit, said coupling element including two conductor loops disposed adjacent to one another, said coupling element including a supply line shared by said two conductor loops, said two conductor loops adjoining said supply line;
said antenna unit including a free arm, and said antenna unit including a feed arm positioned parallel to said supply line of said coupling element; and
said transmitting and receiving unit configured to inductively feed the transmission signal of said electronic circuit into said antenna unit.

2. The hearing aid according to claim 1, wherein said conductor loop includes an auxiliary component.

3. The hearing aid according to claim 1, wherein said two conductor loops each include a respective auxiliary component.

4. The hearing aid according to claim 1, wherein said shared supply line includes an auxiliary component.

5. The hearing aid according to claim 1, which further comprises a waveguide or a coaxial cable connecting said coupling element to said electronic circuit.

6. The hearing aid according to claim 1, wherein said antenna unit includes a feed arm.

7. The hearing aid according to claim 1, wherein said antenna unit includes a feed arm and said two conductor loops are disposed symmetrically relative to said feed arm.

8. The hearing aid according to claim 6, wherein said feed arm forms or at least partially forms an S-shaped or Z-shaped conductor structure.

9. The hearing aid according to claim 6, wherein said feed arm includes an auxiliary component.

10. The hearing aid according to claim 1, wherein said electrically conductive auxiliary element shields said free arm against said plurality of at least one of electrical or electronic units.

11. The hearing aid according to claim 1, wherein said auxiliary element includes a conductor loop.

12. The hearing aid according to claim 11, wherein said plurality of at least one of electrical or electronic units are positioned inside said conductor loop of said auxiliary element.

13. The hearing aid according to claim 1, which further comprises a short-circuit arm connecting said free arm to said auxiliary element.

14. The hearing aid according to claim 13, wherein said short-circuit arm includes an auxiliary component.

15. A hearing aid or classical hearing aid, comprising:

a housing having a baseplate and a housing shell;

a plurality of at least one of electrical or electronic units fastened on said baseplate;

a transmitting and receiving unit for transmitting and receiving electromagnetic waves, said transmitting and receiving unit including an electronic circuit for generating a transmission signal and an antenna unit coupled on said electronic circuit;

said antenna unit including a free arm, said antenna unit including an electrically conductive auxiliary element, said antenna unit including a feed arm, and said free arm being connected through said feed arm to said auxiliary element; and said transmitting and receiving unit configured to inductively feed the transmission signal of said electronic circuit into said antenna unit.

16. The hearing aid according to claim 1, wherein said auxiliary element includes an auxiliary component.

17. The hearing aid according to claim 1, wherein said auxiliary element includes a widened free end.

18. The hearing aid according to claim 1, which further comprises an auxiliary component connecting said free arm to said auxiliary element.

19. The hearing aid according to claim 1, wherein said free arm includes a widened free end.

20. The hearing aid according to claim 1, wherein said free arm includes an auxiliary component.

21. The hearing aid according to claim 1, which further comprises an additional arm branching off from said free arm.

22. The hearing aid according to claim 21, wherein said free arm has ends, and said additional arm is spaced apart from said ends of said free arm.

23. The hearing aid according to claim 22, wherein said additional arm includes a widened free end.

24. The hearing aid according to claim 1, wherein said antenna unit includes a plurality of conductor tracks applied to a substrate or to said baseplate, and said conductor tracks at least partially form said free arm.

25. The hearing aid according to claim 1, wherein said coupling element includes a plurality of conductor tracks applied to a substrate or to said baseplate, said conductor tracks forming said conductor loop or two conductor loops.

26. A hearing aid or classical hearing aid, comprising:

a housing having a baseplate and a housing shell;

a plurality of at least one of electrical or electronic units fastened on said baseplate;

a transmitting and receiving unit for transmitting and receiving electromagnetic waves, said transmitting and receiving unit including an electronic circuit for generating a transmission signal and an antenna unit coupled on said electronic circuit, said transmitting and receiving unit including a coupling element connected to said electronic circuit, said coupling element including a conductor loop;

said antenna unit including a free arm; and said transmitting and receiving unit configured to inductively feed the transmission signal of said electronic circuit into said antenna unit;

said transmitting and receiving unit including a plurality of conductor tracks applied to a substrate having mutually opposite first and second sides;

said conductor tracks including a first portion forming at least a part of said antenna unit and a second portion forming at least a part of said coupling element; and said first portion being applied to said first side of said substrate and said second portion being applied to said opposite second side of said substrate.

* * * * *